United States Patent [19]

Dalaine

[11] Patent Number: 4,750,280

[45] Date of Patent: Jun. 14, 1988

[54] TRENCH-DIGGING MACHINE

[76] Inventor: Jean C. Dalaine, 120 Rue de St Prix, 95150 Taverny, France

[21] Appl. No.: 926,092

[22] Filed: Nov. 3, 1986

[30] Foreign Application Priority Data

Nov. 18, 1985 [FR] France ..... 85 16983

[51] Int. Cl.[4] ..... E02F 5/06

[52] U.S. Cl. ..... 37/86

[58] Field of Search ..... 37/DIG. 3, 16, 80 A, 37/141 R, 117.5, DIG. 12, 142.5, 118 R, 80 R, 83, 86, 191 A, 192 A, 81, 82, 84, 85

[56] References Cited

U.S. PATENT DOCUMENTS

| | | | |
|---|---|---|---|
| 1,108,268 | 8/1914 | Stahl | 37/142.5 |
| 2,526,176 | 10/1950 | VanEyck | 37/83 X |
| 2,648,145 | 8/1953 | Askue | 37/192 |
| 2,667,709 | 2/1954 | Askue | 37/83 |
| 2,692,446 | 10/1954 | Smith | 37/86 |
| 2,981,012 | 4/1961 | Meyer | 37/DIG. 3 |
| 3,307,276 | 3/1967 | Russell | 37/90 |
| 3,577,664 | 5/1971 | Sing et al. | 37/141 R X |
| 3,659,364 | 5/1972 | Wilson | 37/83 |
| 4,164,082 | 8/1979 | Watson | 37/83 |

FOREIGN PATENT DOCUMENTS

| | | | |
|---|---|---|---|
| 491649 | 3/1953 | Canada | 37/81 |
| 1224143 | 6/1960 | France | 37/81 |
| 0840238 | 6/1981 | U.S.S.R. | 37/80 R |

*Primary Examiner*—Edgar S. Burr
*Assistant Examiner*—Moshe I. Cohen
*Attorney, Agent, or Firm*—Young & Thompson

[57] ABSTRACT

The trencher comprises a vehicle having secured to its rear a boom around which a digging chain runs. The boom is slidingly disposed in a sleeve-like frame pivoted to the rear of the vehicle and movable between a lowered operative position and a raised transport position.

9 Claims, 4 Drawing Sheets

TRENCH-DIGGING MACHINE

BACKGROUND OF THE INVENTION

This invention relates to a trench-digging machine of the kind known as a ditch-digging machine in agriculture and a trencher in civil engineering.

In the following description the word "trencher" is to be understood in its broadest sense and is used irrespective of the power of the engine of the machine. The term "trencher" therefore covers ditch-digging machines.

Of course the general idea on which machines of this kind are based derives from excavating machines.

Of course, the digging element of trenchers mainly comprises a support frame, a digging boom, a digging chain and means for removing the dirt.

Two kinds of machine are known for digging trenches in the ground.

In a first kind of trencher, which has the merit of simplicity, the digging boom pivots in a vertical plane around the main transmission shaft driving the digging chain.

The depth of operation is adjusted by the amount of this pivoting—i.e., by the angle of attack on the ground.

The digging boom can therefore be of simple construction; however, the design has a number of disadvantages, more particularly at shallow and medium digging depths, for in such cases the boom is at a very reduced angle to the horizontal and the place of contact between the digging chain and the ground is a long way behind the vehicle.

The machine as a whole is therefore unbalanced. Also, a considerable length of the digging chain is in engagement with the zone where the ground is being attacked, so that friction forces are considerable.

The digging chain therefore wears prematurely and there is substantial mechanical stressing both of the boom pivot and of the system for controlling digging depth.

There are other disadvantages, more particularly as regards control of digging depth, which is delicate because of the reactions of the ground surface on a long overhung lever arm.

Because of all these disadvantages the complete digging apparatus is of poor mechanical strength.

Also, the overhang of the boom leads to considerable sweeping action on curves which tends to accentuate the curves and makes operations difficult.

In another and more sophisticated kind of trencher the boom is secured to a deformable parallelogram, pivots in a vertical plane and engages the ground far behind the carrying vehicle.

This system provides the advantage of separate adjustment of the angle of boom attack and of digging depth, but it has the same disadvantages as the system hereinbefore described, inter alia as regards boom overhang.

Also, the parallelogram is of complex construction comprising numerous pivot spindles and reciprocating actuators. The pivots experience the resultant of the forces exerted on the boom and are therefore subject to severe fatigue. Also, the parallelogram is positioned very high above the ground when the trencher is required to dig a shallow or medium-depth trench.

Consequently, the centre of gravity of the parallelogram is further from the ground, thus helping to further unbalance the complete apparatus. The weakness due to the kind of movement-transmitting system used means that the construction has to be strengthened, so that the weight of the complete apparatus increases.

SUMMARY OF THE INVENTION

It is the object of this invention to obviate these disadvantages while providing satisfactory control both of the angle of attack between the boom and the ground and also of digging depths, optimising efficiency and reducing resistance whatever the nature of the ground, the digging depth or the angle of attack of the digging chain.

According to the invention, the frame is adapted to pivot around a substantially horizontal axis at the rear or front of the vehicle and is movable between: an operative position, in which the bottom part of the frame bears on the ground, the boom is at a reduced inclination to the vertical and the bottom part of the boom is engaged in the ground; and an inoperative transport position in which the frame is raised towards the vehicle and the boom is slid upwards and disengaged from the ground.

Consequently, when the frame is in the operative position with its bottom part resting on the ground, the boom can be slid in the frame in accordance with digging depth. The forces arising during digging tend to make the frame bear more strongly on the ground, so that the ground, and not the carrying vehicle, receives most of the latter forces.

Since the boom is almost vertical in its operative position, the lever arm between the boom and the pivot by way of which the frame is articulated to the vehicle can be very short, so that the complete apparatus is compact and very rigid.

The frame part operative as a sleeve in which the boom can slide provides accurate and rugged guidance of the boom while effectively protecting it from mechanical impacts and also protecting people working near the machine.

Also, boom overhang is very reduced in both the operative and inoperative positions, and so negotiating curves is very easy.

Advantageously, in the operative position the boom is at an angle of from 10° to 20° to the vertical, the bottom part of the boom being to the rear of a vertical plane extending through the boom relatively to the direction of vehicle movement.

This feature contributes towards effective digging at any depth, optimum take-up of digging forces due to the frame bearing on the ground, and reduced overhang of the complete apparatus.

According to a feature of the invention, the frame is connected to the vehicle by at least one reciprocating actuator adapted to move the frame between its operative position and its inoperative transport position.

Preferably, the boom comprises a rectangular-section tubular element and the frame comprises a sleeve-like part of companion cross-section, the tubular element being slidingly received in the latter part.

Because of this cross-sectional companionship the boom is guided satisfactorily in its sliding in respect of bending and twisting forces experienced by the complete apparatus in digging.

Preferably, the bottom part of the frame has two parallel skids which extend in the direction of vehicle movement and which bear on the ground when the frame is in its operative position.

The skids absorb satisfactorily the forces of the frame bearing on the ground while enabling the frame to slide readily over the ground when the carrying and traction vehicle moves.

According to another feature of the invention, the frame has on its end near the vehicle a board or panel or the like which is inclined rearwardly relatively to the direction of vehicle movement and which is operative to remove the dirt.

The board or panel or the like provides lateral clearance of the dirt brought up by the digging chain so that forwards movement of the boom-carrying frame is not hindered by the accumulation of dirt.

DESCRIPTION OF THE DRAWINGS

Other features and advantages of the invention will also become apparent from the following description.

In the accompanying exemplary non-limitative drawings.

DETAILED DESCRIPTION OF THE INVENTION

Figures 1, 2, 3, 4:
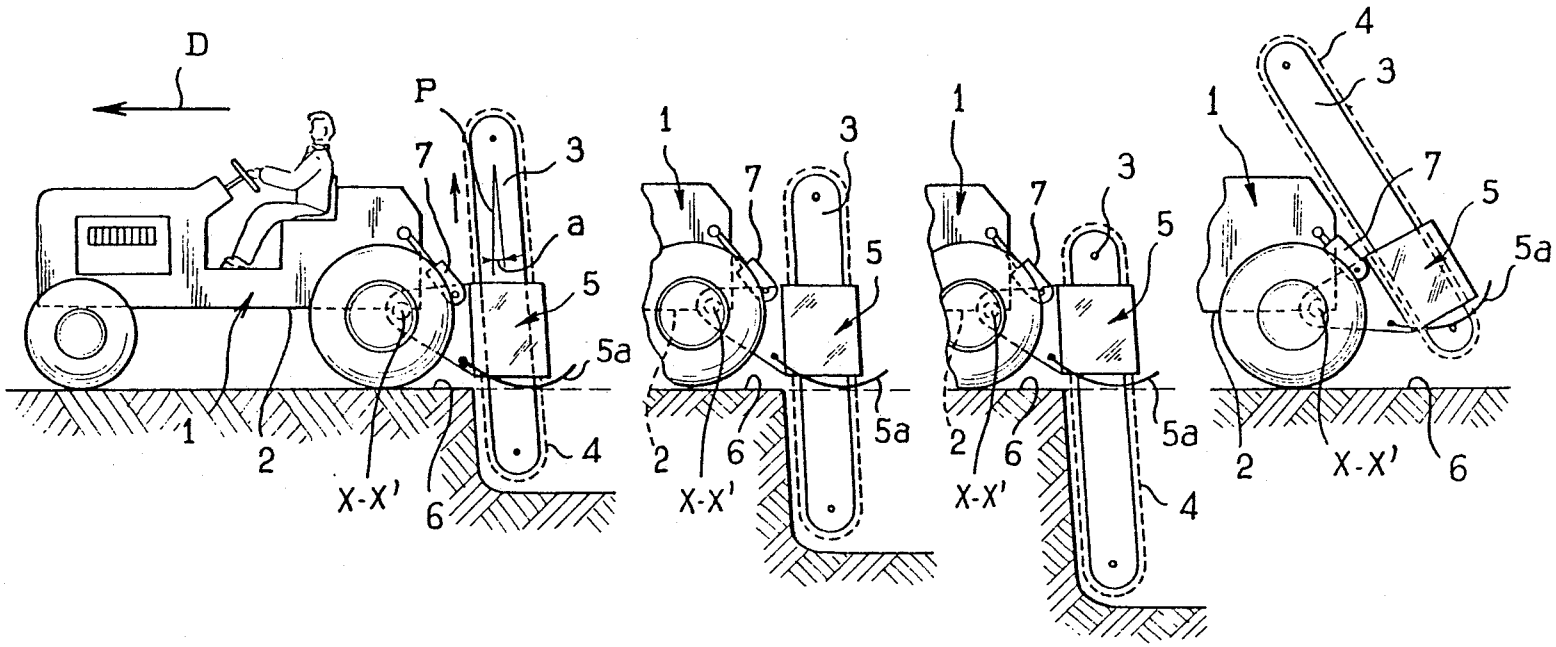
FIG. 1 is a diagrammatic view in elevation of a trencher according to the invention with the frame and boom in their operative positions.
FIGS. 2 and 3 are partial diagrammatic views showing the boom at various digging depths.
FIG. 4 is a diagrammatic view showing the frame and the boom in their inoperative raised positions.

In the embodiment shown in FIG. 1 a trencher comprises a carrying and traction vehicle 1 having a bottom frame 2 having secured to its rear a boom 3 around which an endless digging chain rotates. Boom 3 is slidingly mounted in a sleeve-like frame 5 pivotally connected to the rear of the vehicle frame 2 for pivoting around a substantially horizontal axis X—X'.

The frame 5 is movable between the following two positions:

An operative position which is shown in FIGS. 1–3 and in which the frame bottom part 5*a* bears on the ground 6, the boom 3 is at a reduced inclination to the vertical and the boom bottom part engages in the ground 6, and An inoperative transport position which is shown in FIG. 4 and in which the frame 5 is raised towards the vehicle 1 and the boom 3 is slid upwards and disengaged from the ground 6.

As can be seen in FIGS. 1–3, in the operative position the boom 3 forms an angle a of from 10° to 20° to a vertical plane P perpendicular to the direction D of vehicle movement, the bottom part of the boom being to the rear of the plane P relatively to the direction D of vehicle movement.

The frame 5 is connected to the vehicle 1 by two parallel reciprocating actuators 7 (see also FIG. 5) adapted to move the frame 5 between its operative position of FIGS. 1–3 and its inoperative position of FIG. 4.

Figure 5:
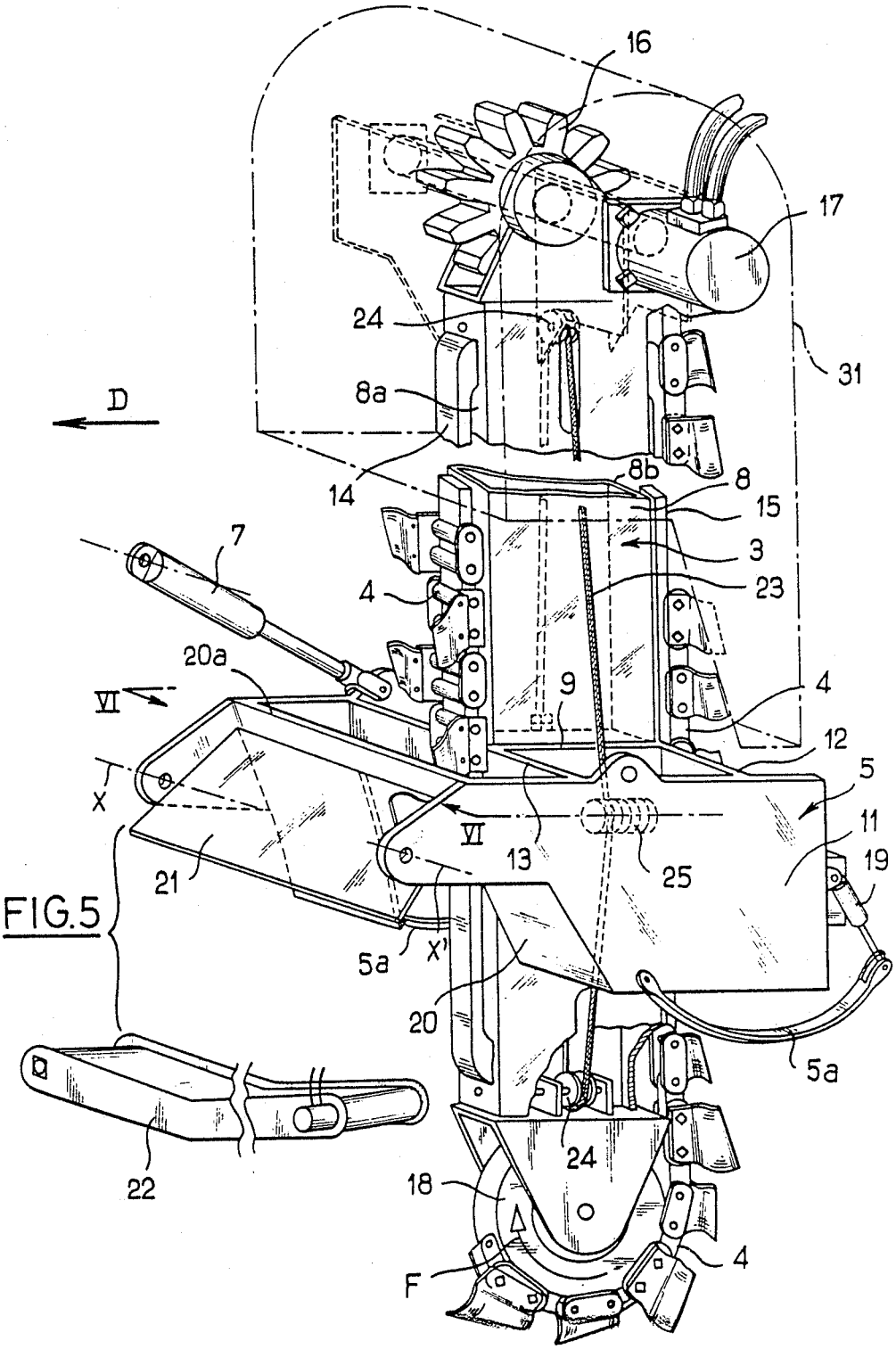
FIG. 5 is a perspective view to an enlarged scale and with parts broken away of the frame and boom.
Figure 6:
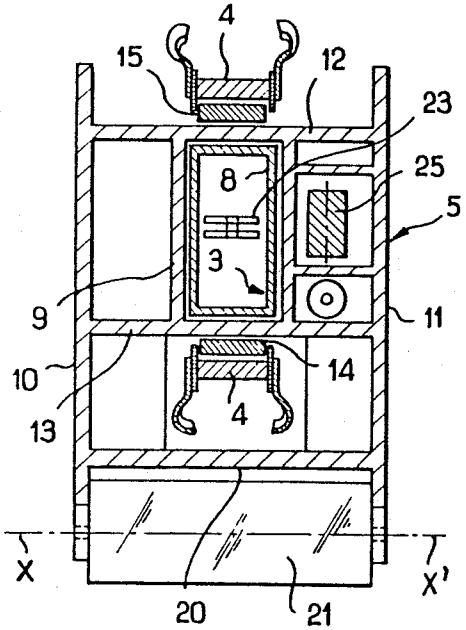
FIG. 6 is a section on the line VI—VI of FIG. 5.

Referring to FIGS. 5 and 6, the boom 3 comprises a steel rectangular-section tubular element 8 and the frame 5 comprises a companion rectangular-section sleeve-like part 9 in which the tubular element 8 is disposed for sliding and without clearance.

As FIG. 6 shows, the frame 5 has two parallel webs 10, 11 articulated at the front end to the frame 2 for pivoting around the axis X—X'. The part 9 is connected to the two webs 10, 11 by two transverse plates 12, 13 operative as cross-members.

The tubular element 8 has on its two surfaces 8*a*, 8*b* perpendicular to the direction D of vehicle movement two guides 14, 15 on which the digging chain 4 bears. The two guides 14, 15 are spaced apart from the two surfaces 8*a*, 8*b* and extend on either side of the part 9 and bear slidingly on the outside surfaces of the part 9 which are disposed in extension of the plates 12, 13.

The digging chain 4 meshes with a gear 16 rotatably mounted at the top end of the boom 3 and driven by a hydraulic motor 17, the chain 4 running around a roller 18 at the bottom of the boom 3. The chain 4 moves in the direction indicated by an arrow F in FIG. 5.

As FIG. 5 shows, the bottom part of the frame 5 has two parallel skids 5*a* which extend in the direction D and which, when the frame 5 is in its operative position, bear on the ground 6 as shown in FIGS. 1–3.

The front end of each skid 5*a* is pivotally secured to one of the frame webs 10, 11 and the rear end is connected to the frame 5 by way of a reciprocating actuator 19. As can also be gathered from FIG. 5, the same has on its end near the vehicle 1 a board or panel or the like 20 which is inclined rearwardly relatively to the direction D and which is operative to remove the dirt.

The frame end near the vehicle also has near top edge 20*a* of the board or panel or the like 20 a plate 21 which is inclined forwardly relatively to the direction D and which extends beyond a removal board 22 secured to the rear of the vehicle 1.

The frame 5 is connected to the boom 3 by means enabling the same to slide relatively to the frame 5 in either direction.

In the embodiment shown in FIGS. 5 and 6, the latter means comprise a system having a cable 23 secured to the boom 3, pulleys 24 and a capstan 25 driven by a hydraulic or electric motor.

Figure 7:
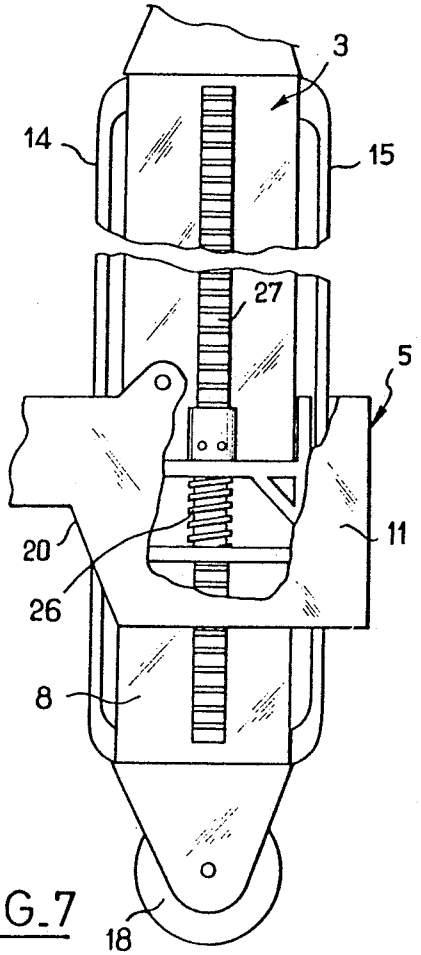
FIG. 7 is a view in elevation with parts broken away of the frame and boom of a constructional variant.

In the embodiment shown in FIG. 7 the means comprise a system having an endless wheel 26 co-operating with a rack 27.

Figure 8:
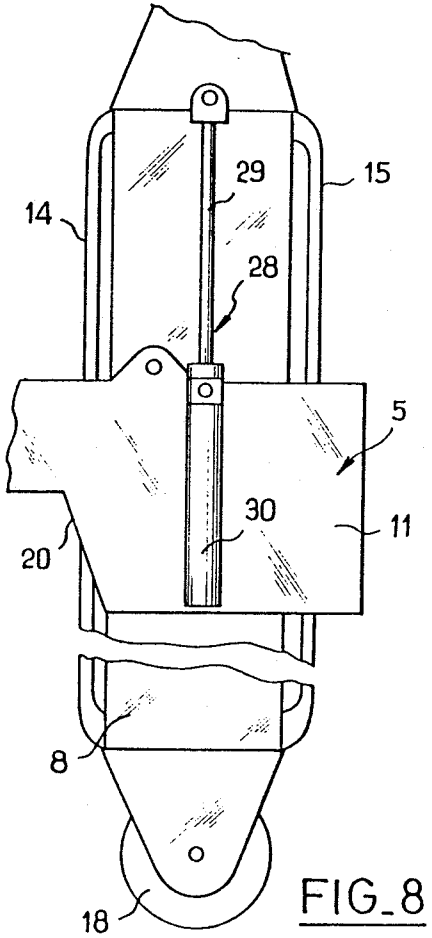
FIG. 8 is a view similar to FIG. 7 of another constructional variant.

In the embodiment shown in FIG. 8, the means comprise a reciprocating actuator 28 having its rod 9 connected to the boom 3 and its casing 30 rigidly connected to the frame 5.

The operation of the trencher according to the invention will now be described with reference to FIGS. 1–4.

To dig a trench in the ground 6 the frame 5 is pivoted by means of the actuators 7 into the operative position shown in FIG. 1. The boom 3 is slid down to touch the ground 6 and the digging chain 4 starts to rotate. The same digs the ground 6 by raising the earth. To adjust digging depth the boom 3 is slid down until the required depth is reached.

To cut a trench of constant depth the vehicle 1 advances at a regular speed.

The forces acting on the boom 3 during digging tend to pivot the frame 5 downwardly. This downwards pivoting movement is limited by the skids 5*a* which bear on the ground 6 and thus receive the forces just referred to.

However, the skids 5*a* enable the frame 5 to slide on the ground 6 as the vehicle 1 advances. The angle a between the boom 3 and the vertical plane P is calculated to optimize the forces which the frame 5 and boom 3 experience.

In the light of the short lever arm embodied by the pivoting frame 5 and the boom 3 and of the sliding guidance for which the sleeve-like part 9 is responsible, the whole embodied by the frame 5 and the boom 3 is very resistant to bending and twisting forces.

The dirt raised by the chain 4 is deflected by the plates 20, 21 and drops on to the board or table 22 or the like for lateral removal thereby. The inclinations of the members 21, 20 are calculated for optimum dirt removal.

Upon completion of the trench the boom 3 can be raised and the frame 5 tilted towards the vehicle 1, as shown in FIG. 4, to disengage the boom 3 from the ground. Since the frame 5 and boom 3 cause very little overhang at the rear of the vehicle 1, the same is readily controllable when negotiating curves and there is no danger of the balance of the vehicle being upset even on slopes. The vehicle 1 can therefore be relatively lightweight.

Figure 9:
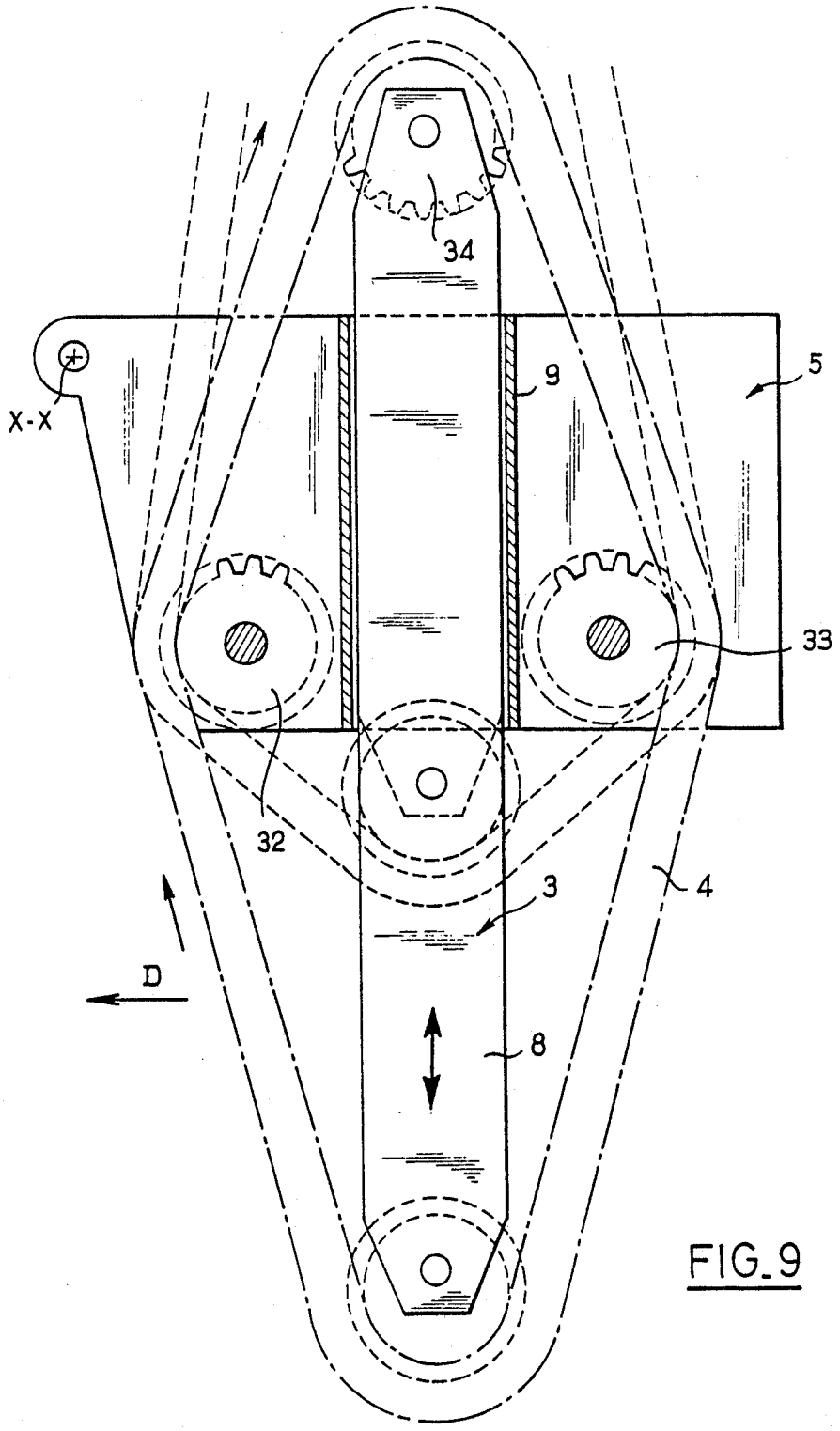
FIG. 9 is a view of another variant.

The invention is not of course limited to the examples hereinbefore described, which can be varied in a wide variety of ways without departing from the scope of the invention. For example, in the variant shown in FIG. 9 the sliding system formed by the boom 3 and part 9 comprises two free gears 32, 33 rigidly secured to the frame 5 and disposed one on either side of the boom 3 and having selectively controlled electromagnetic or hydraulic brakes (not shown) and a pinion 34 which is disposed at the top end of the boom 3 and which drives the digging chain 4 clockwise.

Consequently, when the gear 32 is braked, the boom 3 descends and conversely, when the gear 33 is braked the boom 3 rises.

Of course, a facility such as an electromagnetic system can be devised to lock the boom 3 in the sleeve 9.

Also, the boom-carrying frame 5 could be fixed to the front of the vehicle instead of to the rear thereof.

I claim:

1. A trencher comprising a carrying and traction vehicle (1) having two longitudinal ends, a sleeve-like frame, a boom (3) and a digging chain (4), said boom (3) being slidingly disposed in said sleeve-like frame (5), and said digging chain circulating around said boom; said sleeve-like frame being pivotably mounted for vertical swinging movement about a substantially horizontal axis (X—X') at said one longitudinal end of the vehicle (1) and being swingable about said axis between: a lowered operative position, in which the sleeve-like frame is tilted toward the ground (6) and the boom (3) is at a reduced inclination to the vertical and the bottom part of the boom (3) is engaged in the ground (6); and an inoperative transport position in which the frame (5) is raised toward the vehicle (1) and the boom (3) is slid upward within the frame and disengaged from the ground, the lower part of the sleeve-like frame (5) having members **(5*a*) adapted to bear on the ground (6) in said lowered operative position, thereby receiving and transmitting to the ground the forces transmitted to the frame during digging, and allowing the frame to slide along the ground, the boom (3) comprising a rectangular-section tubular element (8) and the frame (5) comprising a sleeve-like part (9) of companion cross-section, the tubular element (8) being slidingly received in the part (9), the tubular element (8) of the boom (3) having on opposite surfaces (8*a*, 8*b*) thereof perpendicular to the direction (D) of vehicle movement, two guides (14, 15) on which the digging chain (4) bears, the two guides being spaced apart from the two surfaces (8*a*, 8*b*) and extending on either side of the sleeve-like part (9) of the frame (5)**.

2. A trencher according to claim 1, wherein the members comprise two parallel skids **(5*a* ) which extend in the direction (D) of the vehicle movement and which bear on the ground (6) when the frame (5) is in its operative position, the front end of each skid (5*a*) being pivotally connected to the frame (5) whereas the rear end is connected to the frame (5) by a reciprocating actuator (19)**.

3. A trencher according to claim 1, characterised in that in the operative position the boom (3) is at an angle (a) of from 10° to 20° to the vertical (P), the bottom part of the boom (3) being to the rear of the vertical plane including said axis relative to the direction (D) of vehicle movement.

4. A trencher according to claim 1, characterised in that the frame (5) is connected to the vehicle (1) by at least one reciprocating actuator (7) adapted to move the frame (5) between its operative position and its inoperative transport position.

5. A trencher according to claim 1, characterised in that the frame (5) has on its end near the vehicle (1) a board (20) which is inclined rearwardly relative to the direction (D) of vehicle movement and which is operative to remove the dirt.

6. A trencher according to claim 5, characterised in that the frame end near the vehicle (1) also has near the top edge **(20*a*) of the board (20) a plate (21)** which is inclined forwardly relative to the direction (D) of vehicle movement.

7. A trencher according to claim 1, characterised in that the frame (5) is connected to the boom (3) by means enabling the boom (3) to slide relative to the frame (5) in either direction.

8. A trencher according to claim 7, characterised in that the means comprise a system of cables (23) and a capstan (25) driven by a motor.

9. A trencher according to claim 1, characterised in that at least the chain part disposed opposite the vehicle (1) and above the frame (5) is covered by a guard hood (31).

* * * * *